US010454184B2

(12) United States Patent
Boutayeb et al.

(10) Patent No.: US 10,454,184 B2
(45) Date of Patent: Oct. 22, 2019

(54) RECONFIGURABLE RADIAL-LINE SLOT ANTENNA ARRAY

(71) Applicants: Halim Boutayeb, Ottawa (CA); Marek Klemes, Ottawa (CA); Fayez Hyjazie, Ottawa (CA)

(72) Inventors: Halim Boutayeb, Ottawa (CA); Marek Klemes, Ottawa (CA); Fayez Hyjazie, Ottawa (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 275 days.

(21) Appl. No.: 15/418,410

(22) Filed: Jan. 27, 2017

(65) Prior Publication Data

US 2018/0219299 A1 Aug. 2, 2018

(51) Int. Cl.

| | |
|---|---|
| ***H01Q 21/00*** | (2006.01) |
| ***H01Q 21/22*** | (2006.01) |
| ***H01Q 21/24*** | (2006.01) |

(52) U.S. Cl.

CPC ..... *H01Q 21/005* (2013.01); *H01Q 21/0012* (2013.01); *H01Q 21/22* (2013.01); *H01Q 21/24* (2013.01)

(58) Field of Classification Search

CPC .. H01Q 21/0012; H01Q 21/005; H01Q 21/22; H01Q 21/24

See application file for complete search history.

(56) References Cited

U.S. PATENT DOCUMENTS 3,022,506 A * 2/1962 Goebels, Jr. ..... H01Q 21/0012 343/771
6,396,440 B1 * 5/2002 Chen ..... H01Q 3/26 343/700 MS (Continued)

FOREIGN PATENT DOCUMENTS

CN 104051850 A 9/2014
WO 2014140791 A1 9/2014

OTHER PUBLICATIONS

H Boutayeb et al.,"Beam Switching Dual Polarized Antenna Array With Reconfigurable Radial Waveguide Dividers",IEEE Power Transactions on Antennas and Propagation,dated Nov. 2016,total 7 pages.

(Continued)

*Primary Examiner* — Daniel Munoz

(57) ABSTRACT

An antenna that includes a radial waveguide defining a waveguide region between opposed first and second surfaces. A radio frequency (RF) probe is disposed in the waveguide region for generating RF signals, and a plurality of radiating slot antenna elements are disposed on the first surface for emitting the RF signals from the waveguide region. A plurality of spaced apart conductive elements are disposed within the waveguide region. The antenna includes tunable elements that each include a quarter wavelength RF choke coupled through a variable capacitance and an inductive line to a respective one of the conductive elements. A plurality of DC control lines are provided, with each DC control line being connected to at least one of the tunable elements to adjust the variable capacitance thereof. A control circuit is coupled to the DC control lines and configured to selectively apply DC current values to adjust the variable capacitances of the tunable elements to control a propagation direction of the RF signals from the RF probe.

20 Claims, 7 Drawing Sheets

(56) References Cited

U.S. PATENT DOCUMENTS

| | | | | |
|---|---|---|---|---|
| 6,600,382 | B1 * | 7/2003 | Klymyshyn | H04L 27/2017 332/100 |
| 7,129,894 | B1 * | 10/2006 | Winter | H01Q 1/38 343/700 MS |
| 9,397,395 | B2 | 7/2016 | Boutayeb | |
| 9,502,765 | B2 | 11/2016 | Boutayeb et al. | |
| 9,537,461 | B2 | 1/2017 | Boutayeb et al. | |
| 2015/0380814 | A1 | 12/2015 | Boutayeb et al. | |
| 2015/0380815 | A1 | 12/2015 | Boutayeb et al. | |
| 2016/0233588 | A1 * | 8/2016 | Bily | H01Q 25/00 |
| 2016/0294053 | A1 | 10/2016 | Boutayeb | |

OTHER PUBLICATIONS

H. Boutayeb, P. Watson, and T. Kemp, "New reconfigurable power divider based on radial waveguide and cylindrical electromagnetic band gap structure for low power and low cost smart antenna systems," in Proc. IEEE Ant. and Propag. Symposium 2014, Memphis, USA, Jun. 2014.

"Structures périodiques rectangulaires et circulaires en micro-ondes," Halim Boutayeb, Editions Universitaires Européennes, 2010, ISBN 10 :6131535787.

H. Boutayeb, K. Mahdjoubi, and A. C. Tarot, "Analysis of radius-periodic cylindrical structures," in Proc. IEEE AP-S Int. Symp. Dig., vol. 2, 813-816, Columbus, USA, Jun. 2003.

B. Subbarao and V.F. Fusco, "Beam-steerable radial-line slot antenna array", IEE Proc.-Microw. Antennas Propag., vol. 152, No. 6, Dec. 2005.

Paul W. Davis and Marek E. Bialkowski, "Linearly Polarized Radial-Line Slot-Array Antennas with Improved Return-Loss Performance", IEEE Antennas and Propagation Magazine, vol. 41, No. 1, Feb. 1999.

* cited by examiner

RECONFIGURABLE RADIAL-LINE SLOT ANTENNA ARRAY

TECHNICAL FIELD

The present disclosure relates to antenna design, and, in particular embodiments, to an apparatus and method for a reconfigurable radial-line slot antenna array.

BACKGROUND

Modern wireless transmitters of radio frequency (RF) signals or antennas perform beamsteering to manipulate the direction of a main lobe of a radiation pattern and achieve enhanced spatial selectivity. Conventional beamsteering techniques rely on manipulating the phase of RF signals through a series of phase shifters and RF switches. The inclusion of phase shifters, RF switches, and other complex components increase the manufacturing cost and design complexity of agile antennas. Accordingly, less complex agile antenna designs with broadband capabilities are desired.

SUMMARY OF THE INVENTION

Existing radial waveguide antenna structures that enable beam steering often rely on configurations that are not space efficient or rely on costly components or assemblies. Example embodiments are described in which capacitively loaded phase shifting elements are provided to effect beam steering in a radial waveguide structure that includes an array of slot antenna elements.

According to a first aspect is an antenna that includes a radial waveguide defining a waveguide region between opposed first and second surfaces. A radio frequency (RF) probe is disposed in the waveguide region for generating RF signals, and a plurality of radiating slot antenna elements are disposed on the first surface for emitting the RF signals from the waveguide region. A plurality of spaced apart conductive elements are disposed within the waveguide region. The antenna includes a plurality of tunable elements, each tunable element comprising a quarter wavelength RF choke coupled through a variable capacitance and an inductive line to a respective one of the conductive elements. A plurality of DC control lines are provided, with each DC control line being connected to at least one of the tunable elements to adjust the variable capacitance thereof. A control circuit is coupled to the DC control lines and configured to selectively apply DC current values to adjust the variable capacitances of the tunable elements to control a propagation direction of the RF signals from the RF probe.

In some compatible embodiments of the aspects of the invention, the tunable elements each comprise a protective resistor coupling the RF choke to the DC control line, and the radial waveguide comprises a first circular plate defining the first surface and a second circular plate defining the second surface, the radiating slot antenna elements extending through the first circular plate. In further compatible examples, the conductive elements each extend between the first and second circular plates and the tunable elements are disposed on the second circular plate. The RF probe can be located at a center of the waveguide region and the conductive elements disposed in a radially and circumferentially periodic pattern about the RF probe. In even further compatible examples, the slot antenna elements are disposed in a ring on the first circular plate, the slot antenna elements being a greater radial distance from the probe than the conductive elements. At least some of the DC control lines may be connected to two or more of the tunable elements. In some compatible configurations, at least some of the slot antenna elements have a same shape and dimensions, but are oriented in different directions. In some examples, the slot antenna elements have a same shape and dimensions and are oriented in a common direction relative to the RF probe. At least some of the slot antenna elements may include first and second radiating slots, and in some embodiments the first and second slots intersect each other at right angles.

According to a second aspect is a method of beam steering RF signals, comprising: providing a radial waveguide structure that includes: a waveguide region between opposed first and second surfaces; a radio frequency (RF) probe disposed in the waveguide region for generating RF signals; a plurality of radiating slot antenna elements disposed on the first surface for emitting the RF signals from the waveguide region; a plurality of spaced apart conductive elements disposed within the waveguide region; and a plurality of tunable elements, each tunable element comprising a quarter wavelength RF choke coupled through a variable capacitance and an inductive line to a respective one of the conductive elements. The method includes controlling, with a microcontroller, the variable capacitances of the tunable elements to control a propagation direction of the RF signals within the waveguide region.

According to embodiment third aspect is a radial waveguide antenna structure comprising: first and second circular plates defining a radial waveguide region between them; a radio frequency (RF) probe centrally disposed in the waveguide region for generating RF signals; a plurality of radiating slot antenna elements disposed on the first surface for emitting the RF signals from the waveguide region; and a plurality of phase shifters, each comprising an RF choke coupled through a variable capacitance and an inductive line to a conductive element disposed in the waveguide region. The variable capacitances of the phase shifters are adjustable to control a propagation direction of the RF signals within the waveguide region.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different FIGS. generally refer to corresponding parts unless otherwise indicated. The FIGS. are drawn to clearly illustrate the relevant aspects of the embodiments and are not necessarily drawn to scale. Terms describing orientation such as top, bottom, front, back, left and right are used in this disclosure as relative terms.

DETAILED DESCRIPTION OF ILLUSTRATIVE EMBODIMENTS

Disclosed herein are example embodiments for an agile antenna that beamsteers broadband wireless transmissions, e.g., signals in the RF or microwave frequency range. As used herein, the term RF frequencies and RF signals is used to represent frequencies and signals, respectively, in the RF, microwave, and other suitable regions of the spectrum for wireless communications.

Figure 1:
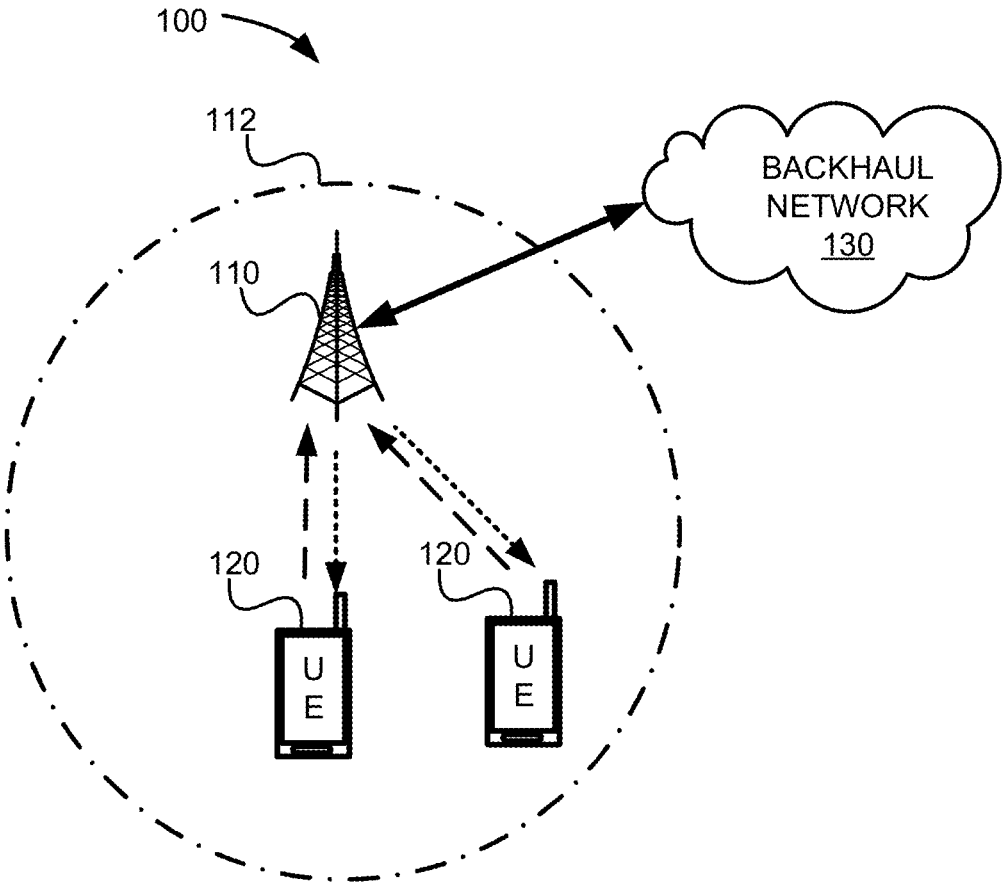
FIG. 1 illustrates a diagram of a wireless network for communicating data.
Figure 2:
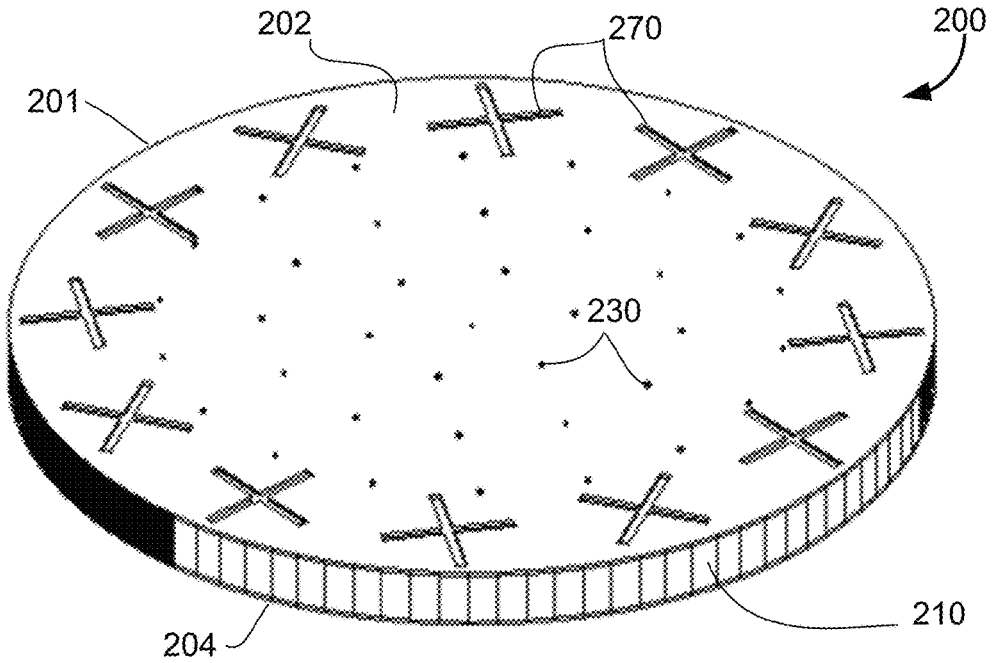
FIG. 2 is an isometric top and front view of a reconfigurable radial-line slot antenna according to example embodiments.

FIG. 1 illustrates a network 100 for communicating data. The network 100 comprises an access point (AP) 110 having a coverage area 112, a plurality of user equipments (UEs) 120, and a backhaul network 130. The AP 110 may comprise any component capable of providing wireless access, e.g., to establish uplink (dashed line) and/or downlink (dotted line) connections with the UEs 120. Examples of the AP 110 include a base station (nodeB), an enhanced base station (eNB), a femtocell, a Wireless LAN or WiFi access point, and other wirelessly enabled devices. The UEs 120 may comprise any components capable of establishing a wireless connection with the AP 110. The backhaul network 130 may be any component or collection of components that allow data to be exchanged between the AP 110 and a remote end (not shown). In some embodiments, the network 100 may comprise various other wireless devices, such as relays, femtocells, etc. The AP 110 or other wireless communication devices of the network 100 may comprise an agile antenna device as described below. The agile antenna is used to transmit/receive the wireless or RF signals with the other devices such as for cellular and/or WiFi communications.

FIGS. 2-6 show a reconfigurable antenna 200 according to example embodiments. The antenna 200 includes a radial waveguide structure 201 composed of first and second parallel circular plates 202, 204 that have opposed, spaced apart surfaces 206, 208 (see FIG. 4) that define an internal waveguide region 203. The parallel plates 202, 204 are electrically connected to each other about their respective perimeters by one or more conductive members 210 forming a short circuit termination. In an embodiment, the conductive member 210 is a circumferential conductive gasket placed near the outer edges of both plates 202, 204. The opposed surfaces 206, 208 of parallel plates 202, 204 are separated by a predetermined height, H, that promotes broadband operation of the antenna. In an example embodiment, the plates 202, 204 are separated by a non-conductive RF permeable medium, which in the illustrated example is air.

Radial-line slot antenna 200 includes a series of conductive vias or elements 214 that extend vertically between the surfaces 206, 208 of the plates 202, 204. In an example embodiment the conductive elements 214 are distributed such that they are radially and circumferentially periodic, as can be seen for example in FIG. 3, in which a central portion of top plate 202 is removed to show the conductive elements 214. As can be seen in the example illustrated in FIG. 3, the conductive elements 214 are arranged along respective circumferential rings R1, R2, R3, with the number of conductive elements 214 doubling in each successive ring further from the antenna center. Within each ring, each element 214 is separated from its two adjacent neighbors by a distance D. Furthermore, each element 214 in the inner ring R1 is separated from the two closet adjacent element 214 in the middle ring R2 by the same distance D, and each element 214 in the middle ring R2 is also separated from the two closet adjacent elements 214 in the outer ring R3 by the same distance D. In the illustrated embodiment, conductive elements 214 are metallic cylinders or pins.

Figure 4:
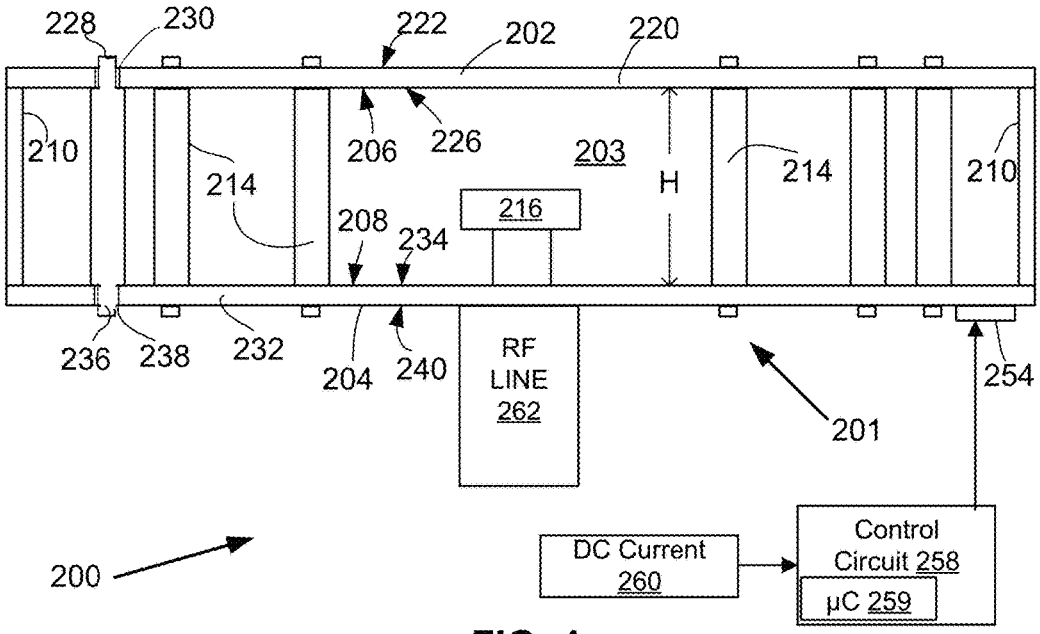
FIG. 4 is a schematic sectional side view of the antenna of FIG. 2.

Referring to FIG. 4, in an example embodiment, the top circular plate 202 of the radial waveguide structure is formed from a multilayer printed circuit board (PCB) that includes a central dielectric substrate layer 220 that is coated with a conductive layer 226 on each of it inner surface 206, outer surface 222 and side edges 224. The upper ends of each of the conductive elements 214 are electrically connected to conductive layer 226, and the conductive layer 226 is grounded through conductive member 210. In example embodiments, the upper ends of conductive elements 214 each include a pin 228 that extends into a corresponding plated-through-hole 230 provided in top circular plate 202.

Figure 5:
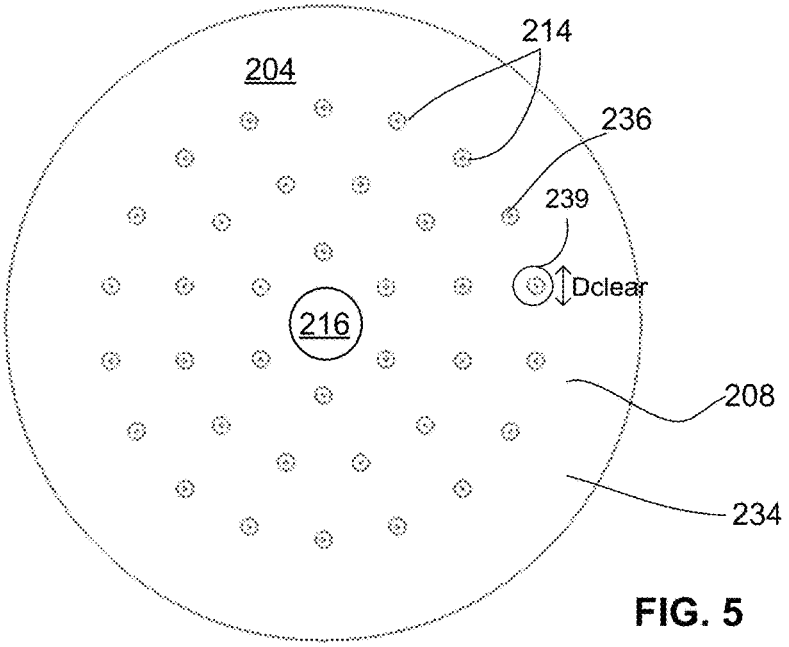
FIG. 5 is top view of the antenna of FIG. 2 with a top plate thereof removed.
Figure 6:
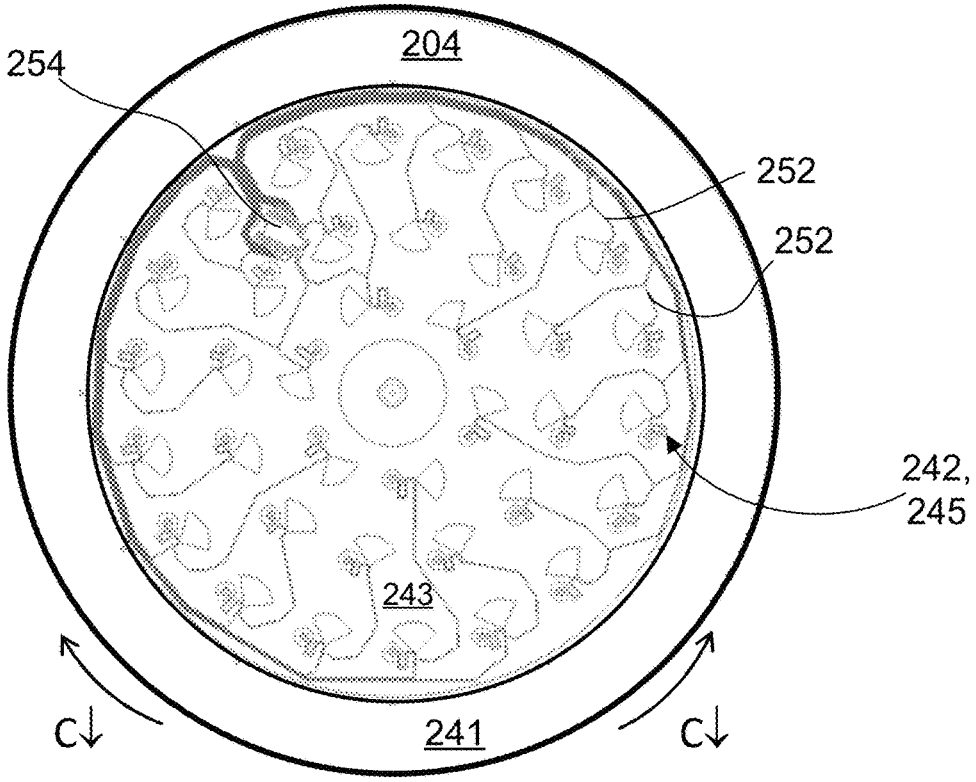
FIG. 6 is a bottom view of the antenna of FIG. 2.

FIG. 5 shows a top view of antenna 200 with the top plate 202 removed, and FIG. 6 shows a bottom view of antenna 200. Referring to FIGS. 4, 5 and 6, in the illustrated embodiment, the bottom circular plate 204 is also formed from a multilayer PCB that includes central dielectric substrate layer 232 with its top or inner surface 208 coated with a conductive layer 234 that faces the inner waveguide region 203. The lower ends of conductive elements 214 are secured to the bottom circular plate 204, but are electrically isolated from the bottom plate conductive layer 234. In an example embodiment the lower ends of conductive elements 214 each include a pin 236 that extends into a corresponding hole 238 provided through the bottom circular plate 204. A nonconductive region 239 of diameter $D_{clear}$ is provided on the inner surface 208 around each of the holes 236 to isolate the pins 236 from conductive layer 234. As best seen in FIG. 6, the bottom or outer surface 240 of the bottom plate 204 includes an outer circumferential region or ring outside of the tunable elements 214 that includes a conductive layer 241 on substrate 232, and an inner circular region 243 in which the substrate 232 is exposed and supports a plurality of tunable elements 242. The number of tunable elements 242 is equal to the number of conductive elements 214 and each tunable element 242 is electrically connected to a respective one of the conductive elements 214, and in particular to the pin 236 of the conductive element 214 that extends through the bottom plate 204.

Figure 7:
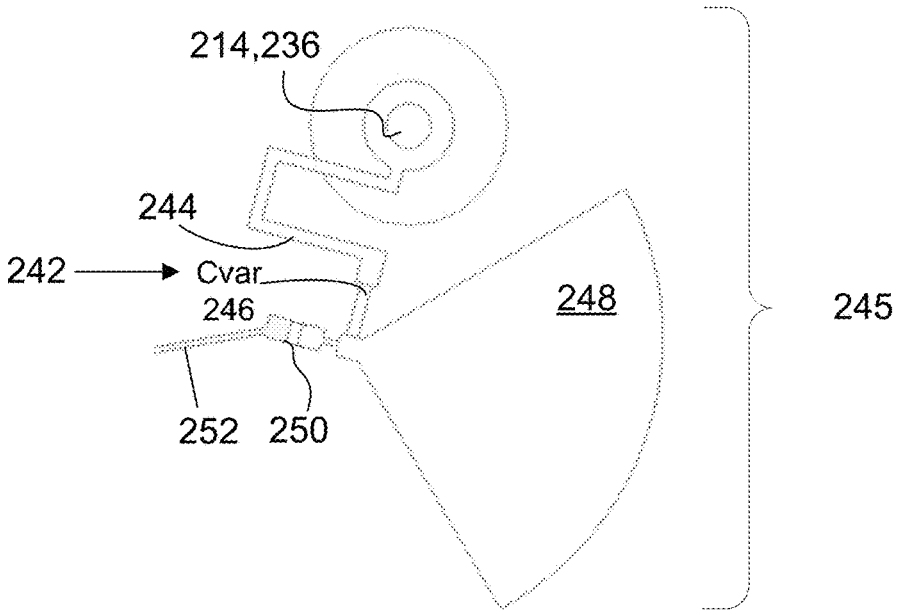
FIG. 7 is a schematic view of a tunable element circuit of the antenna of FIG. 2, according to an example embodiment.

Referring to FIG. 7, each tunable element 242 functions as a loading circuit that couples a conductive element 214 to a respective DC control line 252. In the illustrated embodiment, each tunable element 242 includes a series combination of an inductive micro-strip conductor 244, a variable capacitance element 246 that has a variable capacitance $C_{var}$, an RF choke 248 and a protective resistor 250. The micro-strip 244, which is connected at one end to the conductive element 214, has a length and shape selected to provide an inductance L. The RF choke 248 is a quarter wavelength ($\lambda/4$) open ended radial stub and is provided by a suitably shaped conductive layer formed on substrate 232. The protective resistor 250 is located between the RF choke 248 and the control line 252 and has sufficiently high resistance to prevent any current spikes from entering the control line 252. The combination of the conductive element 214 and the tunable element 242 form a DC controlled phase shifter 245 in which the value $C_{var}$ of variable capacitance element 246 can be adjusted by applying different DC currents on the DC control line 252, which in turn can vary the capacitive loading on the conductive element 214. In some examples, the variable capacitance element 246 may be implemented using a varactor, however different types of capacitive elements can be used. The micro-strips 244 of different tunable elements 242 may have different lengths to optimize the transmission coefficient (increase transmissions over a wider range of frequencies) of the antenna 200. For a given height H between the plates 202, 204, the capacitive loading of each phase shifter 245 is controlled by the diameter of the conductive element 214 (Dw), the inductance L, the variable capacitance $C_{var}$ and the diameter of the clearance space around the conductive element, Dclear.

In an example embodiment the DC control lines 252 from the tunable elements 242 are conductive lines formed on the surface of substrate 232 in region 243 of bottom plate 204. In the illustrated embodiment, the DC control lines 252 lead to an interface circuit 254 that may for example include an integrated circuit chip mounted on the plate 204. Referring to FIG. 4, interface circuit 254 is connected to a control circuit 258 that is configured to selectively apply varying DC current levels from a DC current source 260 to each of the DC control lines 252. In example embodiments control circuit 258 comprises a microcontroller 259 that includes a processor and a storage carrying instructions that configure the control circuit 258 to selectively apply different DC current magnitudes to the different control lines 252 in order to achieve beam steering. Varying the current on DC control lines 252 causes a corresponding change in the variable capacitance $C_{var}$ of the respective variable capacitive elements 246, which in turn can be used to effect beam steering within the antenna 200. In at least some example's the same DC control line 252 may be used to control more than one tunable element 242. For example, the same DC control line can be connected to groups of two or more tunable elements 242 that are adjacent to each other. In the example shown in FIG. 6, each DC control line 252 is used to control a pair of tunable elements 242.

Figure 3:
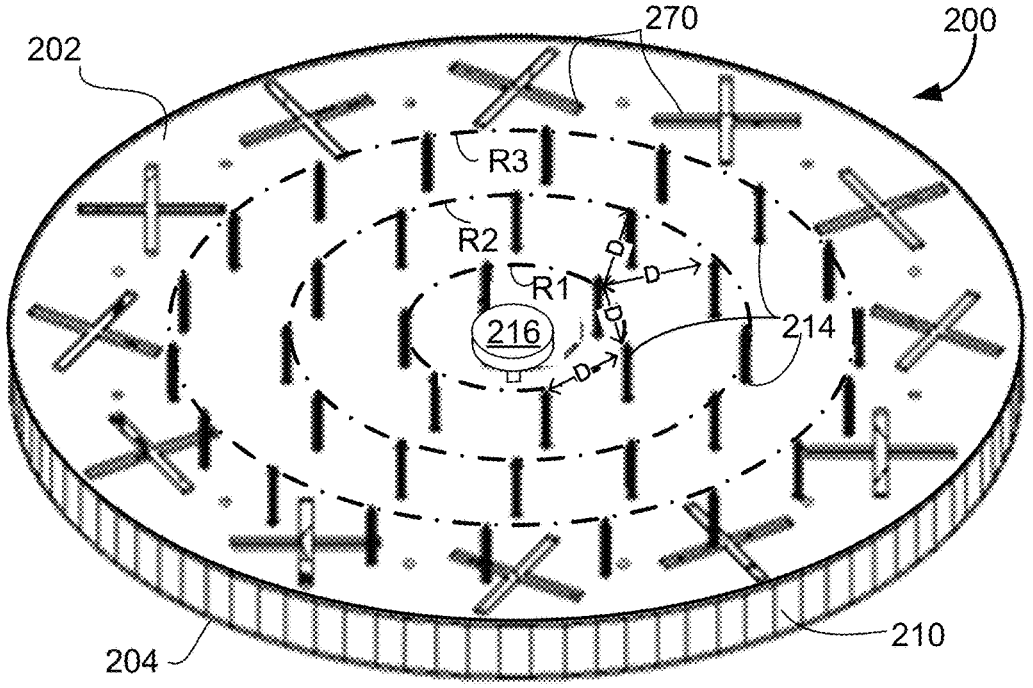
FIG. 3 is an isometric view of the antenna of FIG. 2, with a top plate of the antenna partially cut away showing an internal structure of the antenna.

As seen in FIGS. 3 and 4, an RF feed or probe 216 is located at the center of the antenna 200 in the center of the internal waveguide region 203 between. The RF probe 216 is electrically isolated from the plates 202, 204 and is connected through an opening in bottom plate 204 to an interface connector 262 that allows an RF input and/or output line to be connected to antenna 200. In one example, the connector 262 can be a coaxial interface that connects the RF signal carrying line of a coaxial line to the RF probe 216 and the grounding sheath of the coaxial line to a common waveguide ground that is coupled to conductive layers 226, 234, 241 and conductive gasket member 214.

In example embodiments the conductive elements 214 can be selectively controlled by control circuit 258 to effect beam steaming within the radial waveguide region 203 of antenna 200 relative to the RF probe 216. In particular, increasing the capacitive loading on a conductive element 214 will increase the phase or delay applied on RF signals in the near vicinity of the conductive element 214, and decreasing the capacitive loading on a conductive element 214 will decrease the phase or delay applied on the RF waves in the near vicinity of the conductive element 214. Accordingly, the capacitive values $C_{var}$ can be selectively adjusted to control the direction of RF waves within the radial waveguide region 203 of antenna 200 relative to the central RF probe 216.

In example embodiments, the antenna 200 includes an array of slot antenna elements 270 located in the top plate 202 for emitting RF waves from and/or receiving RF waves into the radial waveguide structure of antenna 200. As seen for example, in FIGS. 2, 3 and 8, the slot antenna elements 270 are circumferentially spaced in a ring near an outer edge of the top plate 202 at a radial distance that is further than the outer ring R3 of conductive elements 214. In example embodiments each slot antenna element includes two slot elements 272, 274 formed through the plate 202, with each slot element having a width W1 and a length L1. In the example embodiment illustrated in FIGS. 2, 3 and 8, the slot elements 272, 274 of each antenna slot element 270 intersect each other at right angles, however other angle of intersection are possible in other embodiments. In the illustrated embodiment the antenna slot elements 270 are periodically located around the outer circumferential region of the top plate 200, but the orientation of the antenna slot antenna elements 270 varies between adjacent slot antenna elements 270 such that the polarization of the adjacent slot antenna elements 270 varies.

Although a number of different configurations are possible, in one non-limiting example embodiment for antenna operation in 5 Ghz-6 GHz frequency band, the slot elements 272, 274 each have a length L1=25 mm that is approximately half of the operating wavelength and a width of W1=2 mm, the antenna 200 has a diameter of 172 mm, the plates 202, 204 are separated by a height of H=10 mm, and the conductive elements 214 each have a diameter Dw of 1.8 mm.

Figure 8:
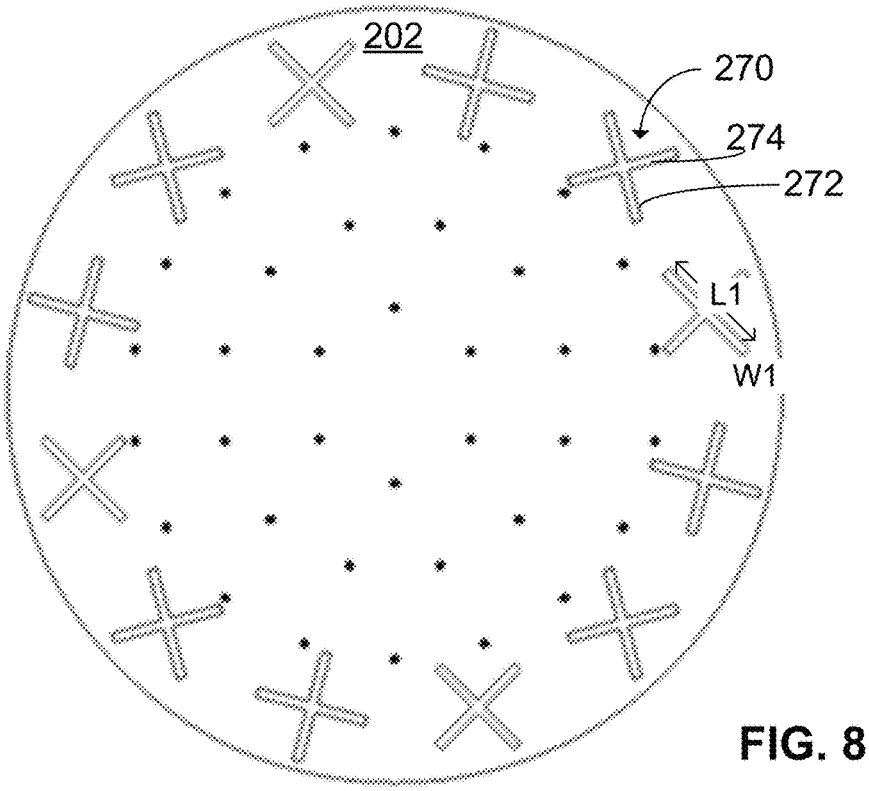
FIG. 8 is a top view of the antenna of FIG. 2.
Figure 9:
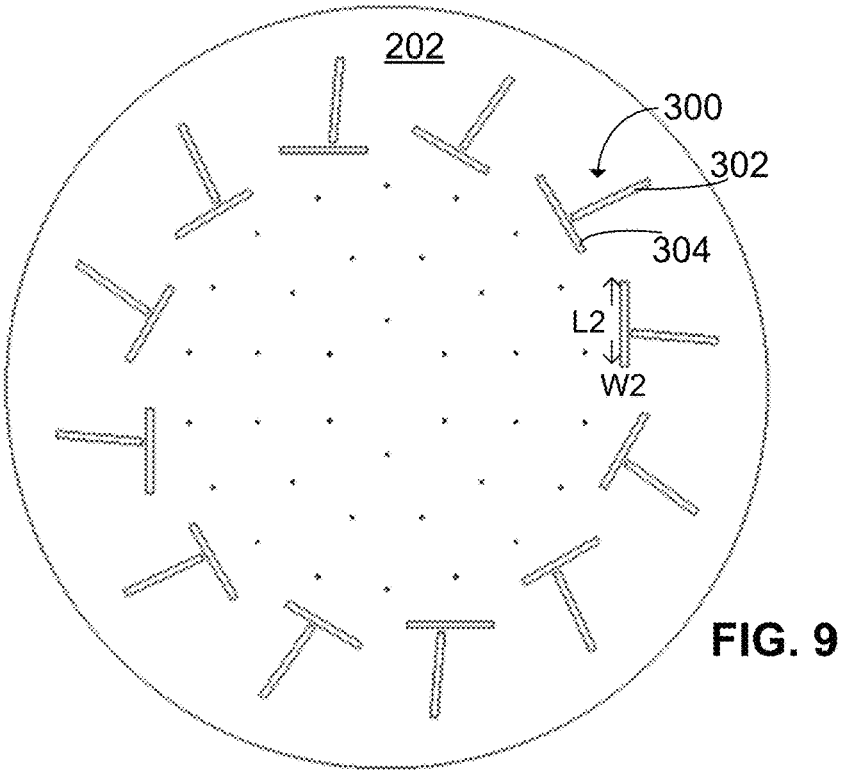
FIG. 9 is a top view of a further embodiment of the antenna of FIG. 2.

FIG. 9 shows a different possible configuration for the slot antenna elements of antenna 200. The antenna 200 of FIG. 9 is identical to the antenna of FIGS. 2-8 except that the slot antenna elements 270 are replaced by slot antenna elements 300, which includes a first slot element 302 and a second slot element 304 that extend at different relative angles in top plate 202. Each slot element 302, 304 has a width W2 (for example 2 mm) and a length L2 (for example 25 mm), but do not intersect with each other. Centers of slots 302 and 304 are separated by a distance that is equal to about a quarter wavelength (for 90 degrees phase shift). Both slots 302, 304 contribute to the radiated electromagnetic wave. The orientation of 302 and 304 are optimized numerically such that the total radiated electromagnetic wave can have a circular polarization (a circular polarization can be obtained with two sources having linear polarizations and a 90 degree phase shift). In the illustrated embodiment the antenna slot elements 300 are periodically located around the outer circumferential region of the top plate 200, and each have a similar radial orientation relative to the central RF probe 216. The configuration of slot antenna elements 300 as shown in FIG. 9 provides for a circular polarization compared to the arbitrary polarization provided by the configuration of slot antenna elements 270 as shown in FIG. 8.

From the above description, it will be appreciated that the antenna 200 can be controlled to effect beam steering. In particular, according to an example method, the control circuit 258 can be configured to selectively control the capacitive loading placed on the conductive elements 214, for the purpose of directing propagation of RF signals within the radial waveguide region 203 towards selected radiating antenna elements 270,300 that are located in different radial areas of the antenna 200. In at least some examples, the described embodiment scan facilitate beam steering in two planes in a low profile package.

In at least some example embodiments the radial waveguide structure 201 used for antenna 200 may be formed using a structure other than two spaced apart PCB's. For example a multilayer technology such as Low Temperature Co-fired Ceramics (LTCC) may be used to form a suitable structure.

Figure 10:
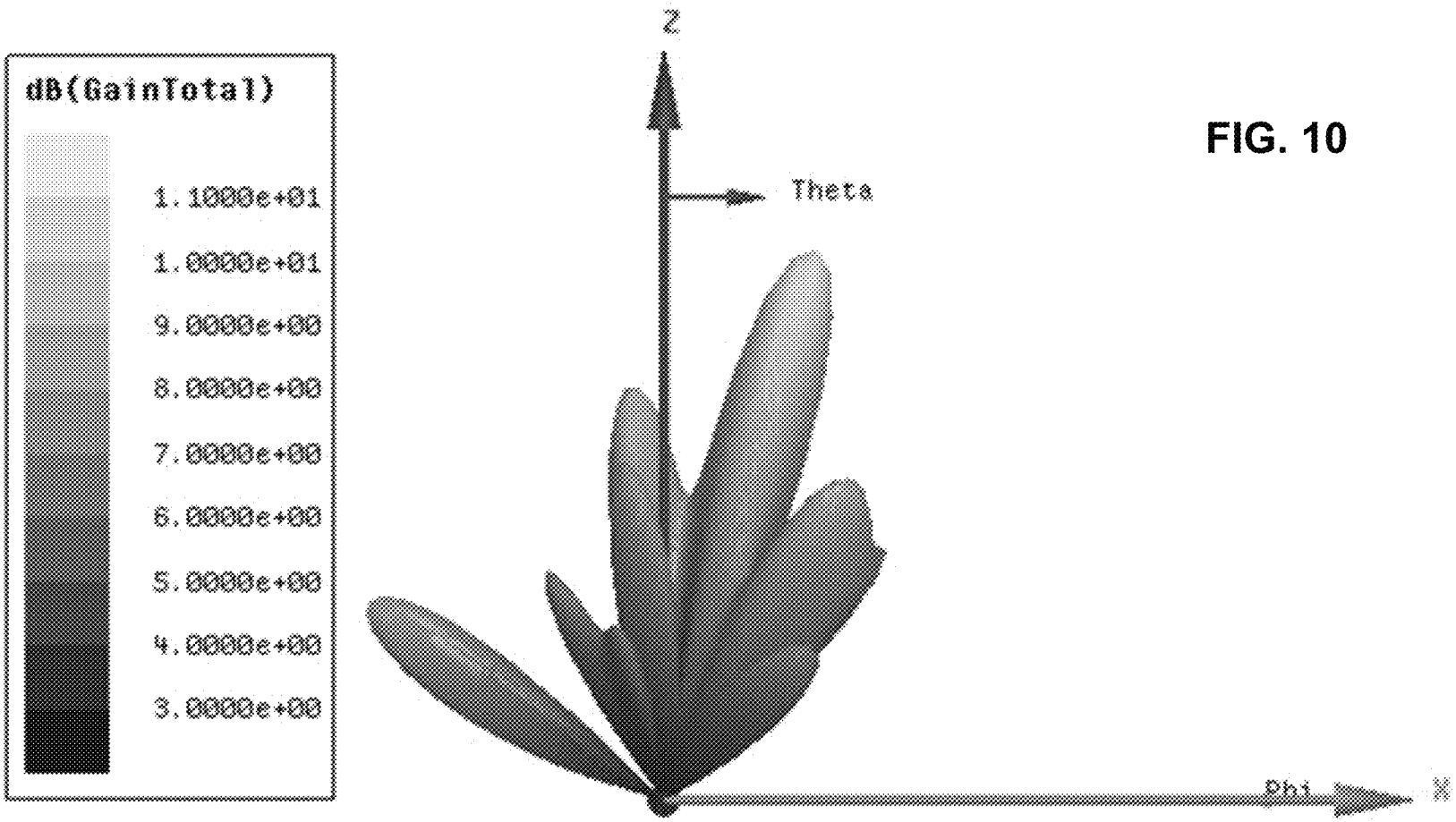
FIG. 10 illustrates simulated RF signal radiation patterns from an antenna resulting from variations in capacitive loading, according to example embodiments.

FIG. 10 illustrates simulated RF signal radiation patterns from an antenna 200 resulting from variations in the capacitive loading on the conductive elements 214. An example of variation of the capacitances is shown by the arrows labelled with "C" in FIG. 6. The plane of symmetry for the capacitance variation controls the direction of the radiated beam in phi angle. The range of variation of the capacitance controls the direction of the radiated beam in theta angle.

Figure 11:
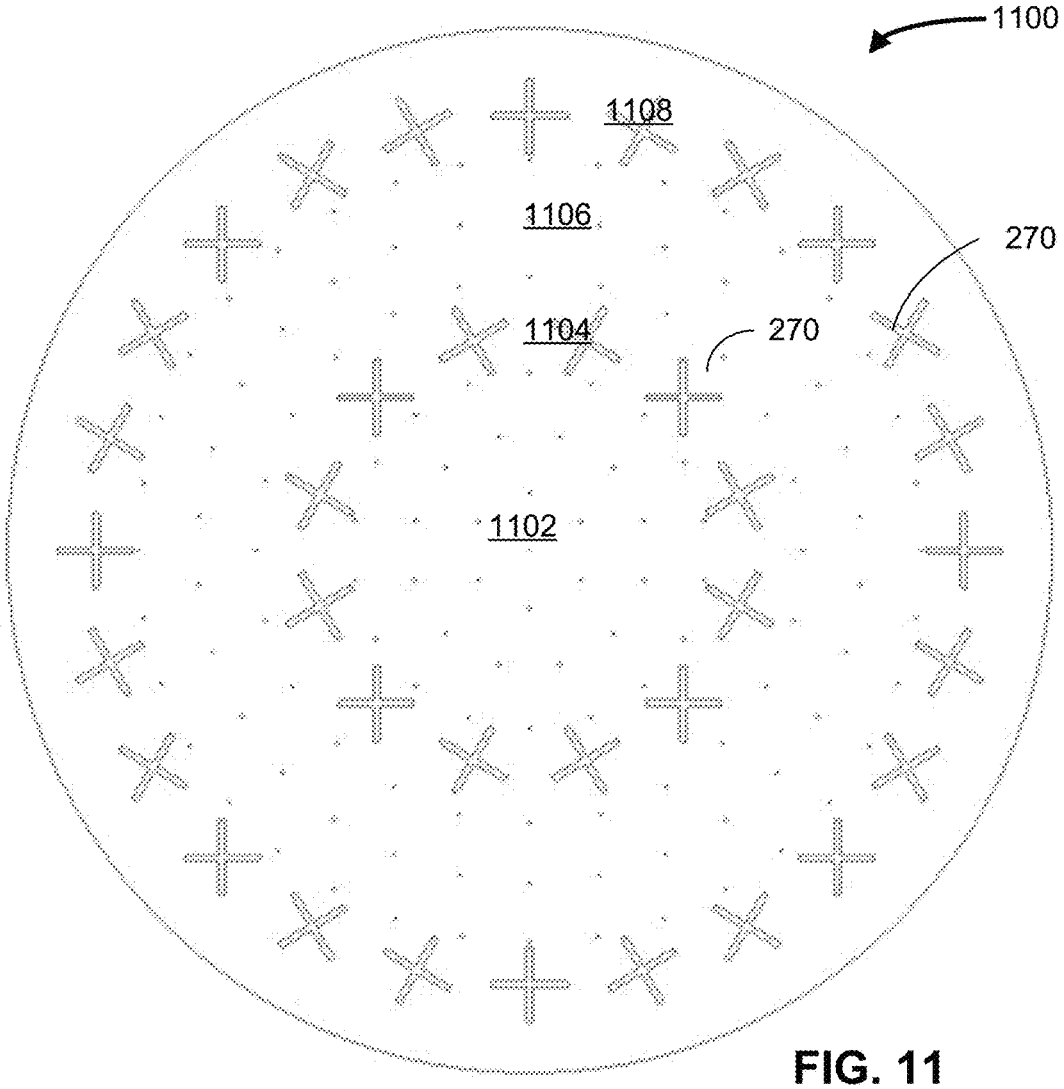
FIG. 11 is a top view of a further example embodiment of an antenna.

As disclosed above, the slot antenna elements 270/300 are circumferentially spaced in a ring near an outer edge of the top plate 202 at a radial distance that is further than the outer ring R3 of conductive elements 214. However, in some embodiments the arrangement can be extended to include additional groupings of conductive elements 214 and slot antenna elements. For example, FIG. 11 illustrates a top view of a further example embodiment of an antenna 1100, which is identical to antenna 200 described above except for differences that will be apparent from the description and the Figures. Similar to antenna 200, Antenna 1100 includes a central circular region 1102 includes periodically arranged conductive elements 114, surrounded by a ring region 114 of slot antenna elements 270, However, antenna 1100 is extended to include a further ring region 1106 surrounding ring region 1104, with further ring region 1106 including a further set of tunable element controlled conductive elements 114, and that further ring region 1106 is surrounded by a larger ring region 1108 that includes a further set of slot antenna elements 270. In some examples, different slot antenna element configurations can be used in the different ring regions 1104, 1108 to provide further emission diversity options.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

The invention claimed is:

1. An antenna comprising:

a radial waveguide defining a waveguide region between opposed first and second surfaces;

a radio frequency (RF) probe disposed in the waveguide region for generating RF signals;

a plurality of radiating slot antenna elements disposed on the first surface for emitting the RF signals from the waveguide region;

a plurality of spaced apart conductive elements disposed within the waveguide region;

a plurality of tunable elements, each tunable element comprising a quarter wavelength RF choke coupled through a variable capacitance and an inductive line to a respective one of the conductive elements;

a plurality of DC control lines, each DC control line being connected to at least one of the tunable elements to adjust the variable capacitance thereof; and a control circuit coupled to the DC control lines and configured to selectively apply DC current values to adjust the variable capacitances of the tunable elements to vary capacitive loading applied to the conductive elements and thereby control propagation within the waveguide region of the RF signals from the RF probe.

2. The antenna of claim 1 wherein the tunable elements each comprise a protective resistor coupling the RF choke to the DC control line.

3. The antenna of claim 2 wherein the radial waveguide comprises a first circular plate defining the first surface and a second circular plate defining the second surface, the radiating slot antenna elements extending through the first circular plate.

4. The antenna of claim 3 wherein the conductive elements each extend between the first and second circular plates and the tunable elements are disposed on the second circular plate.

5. The antenna of claim 3 wherein the RF probe is located at a center of the waveguide region and the conductive elements are disposed in a radially and circumferentially periodic pattern about the RF probe.

6. The antenna of claim 5 wherein the slot antenna elements are disposed in a ring on the first circular plate, the slot antenna elements being a greater radial distance from the probe than the conductive elements.

7. The antenna of claim 6 wherein at least some of the DC control lines are connected to two or more of the tunable elements.

8. The antenna of claim 1 wherein at least some of the slot antenna elements have a same shape and dimensions, but are oriented in different directions.

9. The antenna of claim 1 wherein the slot antenna elements have a same shape and dimensions and are oriented in a common direction relative to the RF probe.

10. The antenna of claim 1 wherein at least some of the slot antenna elements include first and second radiating slots.

11. The antenna of claim 10 wherein the first and second slots intersect each other at right angles.

12. A method of beam steering RF signals, comprising:

providing a radial waveguide structure that includes: a waveguide region between opposed first and second surfaces; a radio frequency (RF) probe disposed in the waveguide region for generating RF signals; a plurality of radiating slot antenna elements disposed on the first surface for emitting the RF signals from the waveguide region; a plurality of spaced apart conductive elements disposed within the waveguide region; and a plurality of tunable elements, each tunable element comprising a quarter wavelength RF choke coupled through a variable capacitance and an inductive line to a respective one of the conductive elements, and controlling, with a microcontroller, the variable capacitances of the tunable elements to vary capacitive loading applied to the conductive elements and thereby control propagation of the RF signals within the waveguide region.

13. The method of claim 12 wherein the radial waveguide comprises a first circular plate defining the first surface and a second circular plate defining the second surface, the radiating slot antenna elements extending through the first circular plate, the conductive elements each extending between the first and second circular plates and the tunable elements are disposed on the second circular plate.

14. The method of claim 13 wherein the RF probe is located at a center of the waveguide region and the conductive elements are disposed in a radially and circumferentially periodic pattern about the RF probe, and the slot antenna elements are disposed in a ring on the first circular plate, the slot antenna elements being a greater radial distance from the probe than the conductive elements.

15. A radial waveguide antenna structure comprising:

first and second circular plates defining a radial waveguide region between them;

a radio frequency (RF) probe centrally disposed in the waveguide region for generating RF signals;

a plurality of radiating slot antenna elements disposed on the first surface for emitting the RF signals from the waveguide region;

a plurality of phase shifters, each comprising an RF choke coupled through a variable capacitance and an inductive line to a conductive element disposed in the waveguide region;

the variable capacitances of the phase shifters being adjustable to vary capacitive loading applied to the conductive elements to control propagation of the RF signals within the waveguide region.

16. The structure of claim 15 wherein the RF choke is a quarter wavelength RF choke and the variable capacitances are each controlled by DC control signals applied thereto through the RF chokes.

17. The structure of claim 16 wherein the RF probe is located at a center of the waveguide region, the conductive elements are disposed in a periodic pattern about the RF probe, and the slot antenna elements are disposed in a ring on the first circular plate.

18. The structure of claim 17 wherein the slot antenna elements are a greater radial distance from the probe than the conductive elements.

19. The structure of claim 17 wherein at least some of the slot antenna elements include first and second radiating slots.

20. The structure of claim 19 wherein the first and second slots intersect each other at right angles.

* * * * *